US009031440B2

(12) United States Patent
Fujiwara

(10) Patent No.: US 9,031,440 B2
(45) Date of Patent: May 12, 2015

(54) HEATING APPARATUS AND IMAGE FORMING APPARATUS

(71) Applicant: Canon Kabushiki Kaisha, Tokyo (JP)

(72) Inventor: Yuji Fujiwara, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 131 days.

(21) Appl. No.: 13/854,403

(22) Filed: Apr. 1, 2013

(65) Prior Publication Data

US 2013/0266333 A1 Oct. 10, 2013

(30) Foreign Application Priority Data

Apr. 6, 2012 (JP) ..... 2012-087406

(51) Int. Cl.
*G03G 15/20* (2006.01)
*H05B 1/02* (2006.01)

(52) U.S. Cl.
CPC ..... *G03G 15/2039* (2013.01); *H05B 1/0241* (2013.01); *G03G 2215/2035* (2013.01)

(58) Field of Classification Search
CPC ... G03G 15/2039; G03G 15/80; H05B 1/0241
USPC ..... 399/69, 88, 37; 219/216, 494, 497
See application file for complete search history.

(56) References Cited

U.S. PATENT DOCUMENTS

2006/0078344 A1* 4/2006 Kawazu et al. ..... 399/69
2011/0280597 A1 11/2011 Shimura et al.

FOREIGN PATENT DOCUMENTS

JP 3372914 B2 2/2003
JP 2009-186933 A 8/2009

* cited by examiner

*Primary Examiner* — Sophia S Chen
(74) *Attorney, Agent, or Firm* — Fitzpatrick, Cella, Harper & Scinto

(57) ABSTRACT

The heating apparatus includes a heat generating member which generates heat when power is supplied from an AC power supply, a temperature detection device which detects temperature of the heat generating member, a current detection device which detects a value of current flowing in the heat generating member; and a control unit which controls the temperature of the heat generating member by controlling power supplied to the heat generating member, in which the control unit detects a drop of an input voltage of the AC power supply based on a maximum suppliable power ratio determined by using a value of current suppliable to the heat generating member, the current value detected by the current detection device, and a ratio of power supplied to the heat generating member obtained based on the temperature detected by the temperature detection device.

11 Claims, 11 Drawing Sheets

PRIOR ART

HEATING APPARATUS AND IMAGE FORMING APPARATUS

BACKGROUND OF THE INVENTION

1. Field of the Invention

The present invention relates to a heating apparatus used for an image forming apparatus such as a copier, a laser beam printer, or a facsimile, and to an image forming apparatus including the heating apparatus.

2. Description of the Related Art

A heating fixing apparatus, which is included in an image forming apparatus such as an electrophotographic copier or laser beam printer, fixes an unfixed image (toner image) formed on a transfer sheet by an image forming method such as an electrophotographic process onto the transfer sheet. As an example of the heating fixing apparatus, Japanese Patent Application Laid-Open No. 2009-186933 discloses a heating-roller-type heating fixing apparatus including a halogen heater as a heat source and a film-heating-type heating fixing apparatus including a ceramic heater as a heat source.

In general, a heater as a heat source is connected to a commercial AC power supply via a switching element such as a bidirectional thyristor (hereinafter referred to as a "triac") and is supplied with power from the commercial AC power supply. The heating fixing apparatus including the heater as a heat source is equipped with a temperature detection element, for example, a thermistor thermosensitive element. Further, the temperature detection element detects the temperature of the heating fixing apparatus, and a sequence controller performs on/off control of the switching element based on the detected temperature information. Thus, power supply to the heater as a heat source of the heating fixing apparatus is performed or stopped, and hence temperature control is performed so that the temperature of the heating fixing apparatus becomes a target temperature. The on/off control for the ceramic heater is performed usually by phase control or wave number control of the commercial AC power supply.

In order to adjust the temperature of the heating fixing apparatus, the sequence controller compares the temperature detected by the temperature detection element with a predetermined target temperature so as to calculate a ratio of power to be supplied to the heater. Further, the sequence controller determines a phase angle or a wave number corresponding to the calculated power ratio, and performs on/off control of the switching element based on the phase condition or the wave number condition.

Next, a description is given of a switching power supply having a unit for detecting that the commercial AC power supply voltage has dropped. In the switching power supply, when a switching action continues in a state where the commercial AC power supply voltage is dropped, a rated current value may be exceeded due to an overcurrent state of the switching current, or stress may be applied to each element due to abnormal heating of a circuit component. Therefore, Japanese Patent No. 3372914, for example, discloses a switching power supply that monitors a DC voltage value after the AC voltage is rectified and smoothed, in order to detect that an input voltage from the commercial AC power supply has dropped.

FIG. 10 is a functional block diagram of a switching power supply disclosed in Japanese Patent No. 3372914. The switching power supply of FIG. 10 includes a rectification circuit 2 which inputs an AC voltage $V_{AC}$ from an AC power supply 1 and converts the AC voltage $V_{AC}$ into a DC voltage, and a stabilization power circuit 7 which rectifies and smoothes the DC voltage as an input voltage $V_{IN}$ smoothed by a smoothing capacitor 3 so as to output a DC output voltage $V_{OUT}$. Further, the switching power supply includes an input shut-down detection circuit 5 which monitors the AC voltage $V_{AC}$ and outputs an input shut-down signal when the input is shut down, and a low input voltage protection circuit 6 which monitors the input voltage $V_{IN}$ and stops operation of the stabilization power circuit 7 when the input voltage $V_{IN}$ becomes a predetermined voltage value or lower. The low input voltage protection circuit 6 detects whether or not the voltage value of the DC voltage $V_{IN}$ smoothed by the smoothing capacitor 3 is a predetermined voltage or lower based on dividing resistors in the low input voltage protection circuit 6. Then, when it is detected that the voltage value of the DC voltage $V_{IN}$ is dropped to the predetermined voltage or lower, the low input voltage protection circuit 6 operates to stop the output from the stabilization power circuit 7, and hence components such as elements in the input side as a primary side are protected.

However, in the switching power supply disclosed in Japanese Patent No. 3372914, when the input voltage from the commercial AC power supply gradually drops, and the low input voltage protection circuit 6 operates, the following problem occurs. Specifically, in the case where record data is being written in a recording device such as a hard disk drive by using the DC output voltage $V_{OUT}$ of the switching power supply, if the low input voltage protection circuit 6 operates to stop the output of the switching power supply, the power supply to the recording device is shut down. As a result, the record data that is being written in the recording device may not be written in a normal way, and hence the record data may be damaged.

Therefore, in order to solve this problem, it is necessary to safely stop the writing operation of the recording device before the output of the switching power supply is stopped. In the circuit structure of Japanese Patent No. 3372914 illustrated in FIG. 10, when the low input voltage protection circuit 6 detects that the input voltage $V_{IN}$ is a predetermined voltage or lower, the recording device is notified that the output of the power supply will be stopped in a predetermined time, and hence the recording device stops the writing operation. Then, after the predetermined time passes, the output of the stabilization power circuit 7 is stopped so that a damage to the record data can be avoided. In addition, there is also a method of providing the switching power supply with a low voltage detection circuit separately, the low voltage detection circuit performing low voltage detection of the input voltage from the commercial AC power supply at a voltage higher than the detection voltage of the low input voltage protection circuit 6. By this method too, it is possible to detect that the input voltage from the commercial AC power supply drops, and to stop the writing operation of the recording device before stopping the output of the stabilization power circuit 7.

However, in order to realize this method, it is necessary to dispose an additional delay circuit for stopping the output of the stabilization power circuit at the timing after a predetermined time, or an additional low voltage detection circuit for detecting that the input voltage from the commercial AC power supply drops. Therefore, there is a problem that the circuit scale and cost are increased.

SUMMARY OF THE INVENTION

In view of the above-mentioned background, a purpose of the invention is to provide a heating apparatus that can detect a drop of an input voltage from a commercial AC power supply without an additional circuit or an increase of cost.

According to an exemplary embodiment of the present invention, a purpose of the invention is to provide a heating apparatus including a heat generating member which generates heat when power is supplied from an AC power supply; a temperature detection device which detects temperature of the heat generating member; a current detection device which detects a value of current flowing in the heat generating member; and a control unit which controls the temperature of the heat generating member by controlling power supplied to the heat generating member. The control unit detects a drop of an input voltage of the AC power supply based on a maximum suppliable power ratio obtained by using a value of current suppliable to the heat generating member, a current value detected by the current detection device, and a ratio of power supplied to the heat generating member obtained based on the temperature detected by the temperature detection device.

Further, according to another exemplary embodiment of the present invention, another purpose of the invention is to provide an image forming apparatus including an image forming unit for forming an image on a recording medium, and a fixing unit for fixing the image on the recording medium by heating the recording medium on which the image is formed by the image forming unit. The fixing unit includes a heat generating member which generates heat when power is supplied from an AC power supply, a temperature detection device which detects temperature of the heat generating member, a current detection device which detects a value of current flowing in the heat generating member, and a control unit which controls the temperature of the heat generating member by controlling power supplied to the heat generating member. The control unit detects a drop of an input voltage of the AC power supply based on a maximum suppliable power ratio obtained by using a value of current that suppliable to the heat generating member, the current value detected by the current detection device, and a ratio of power supplied to the heat generating member obtained based on the temperature detected by the temperature detection device.

Further features of the present invention will become apparent from the following description of exemplary embodiments with reference to the attached drawings.

DESCRIPTION OF THE EMBODIMENTS

Next, a specific structure of the present invention to solve the above-mentioned problem is described below with reference to embodiments. Note that, the embodiments described below are merely examples and should not be interpreted to limit the technical scope of the present invention.

First Embodiment

<Outline of Image Forming Apparatus>

Figure 1A:
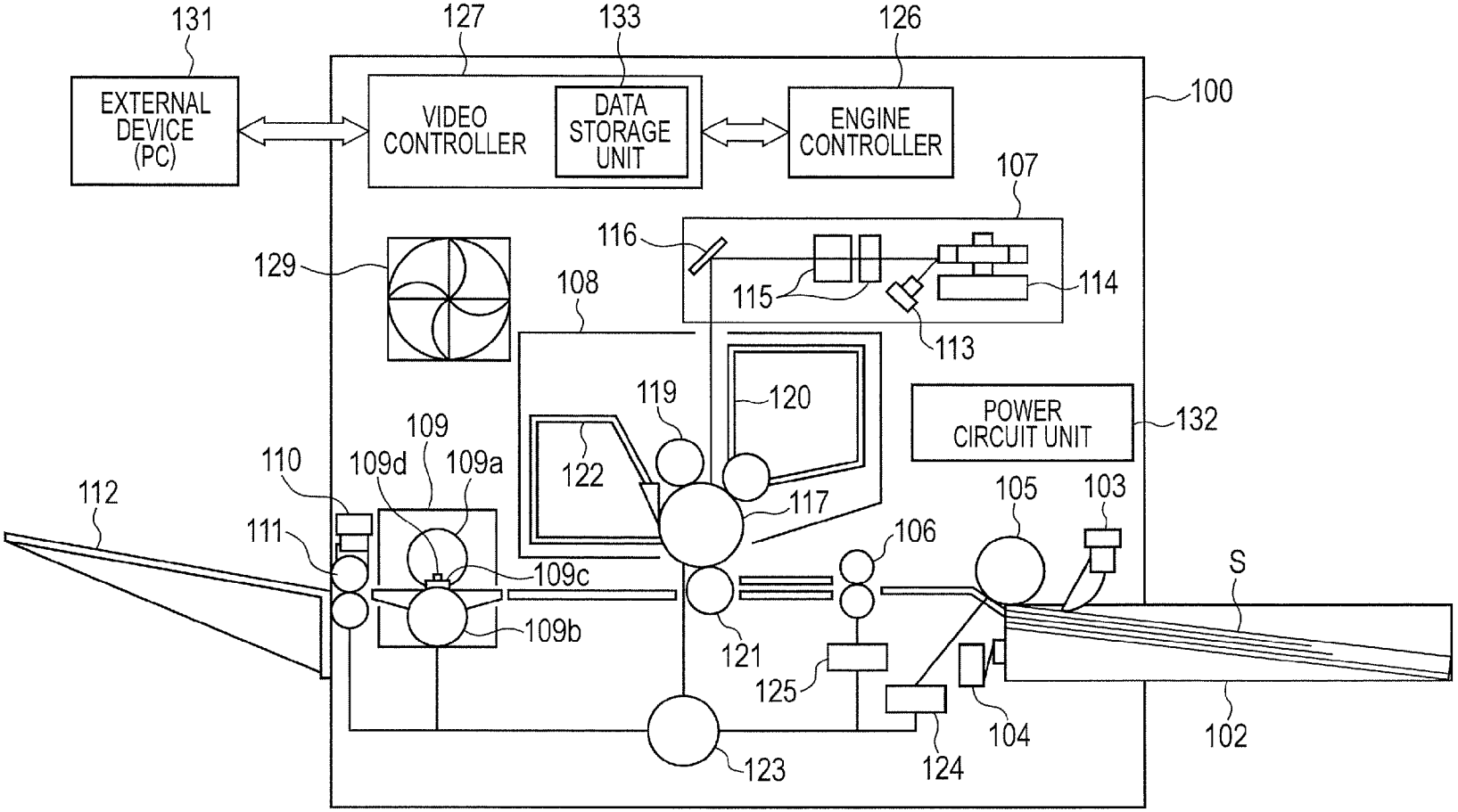
FIG. 1A illustrates a schematic structural diagram of an image forming apparatus according to first and second embodiments of the present invention.

FIG. 1A is a schematic structural diagram of an image forming apparatus using an electrophotographic process, and illustrates a schematic structure of a laser beam printer as an example of the image forming apparatus. An image forming apparatus main body 100 (hereinafter referred to as a "main body 100") includes a cassette 102 for containing recording sheets S. Further, the main body 100 includes a cassette presence sensor 103 for detecting presence or absence of the recording sheets S in the cassette 102, and a cassette size sensor 104 including multiple micro switches for detecting the size of the recording sheets S in the cassette 102. In addition, a sheet feed roller 105 for sending out the recording sheet S from the cassette 102, and the like are disposed. In addition, on the downstream side of the sheet feed roller 105 in a conveyance direction of the recording sheet S, there is disposed a registration roller pair 106 for conveying the recording sheet S in a synchronized manner.

On the downstream side of the registration roller pair 106 in the conveyance direction of the recording sheet S, there is disposed an image forming unit 108 for forming a toner image on the recording sheet S based on a laser beam from a laser scanner unit 107. Further, on the downstream side of the image forming unit 108 in the conveyance direction of the recording sheet S, there is disposed a fuser 109 as a heating fixing apparatus of this embodiment for heating and fixing the toner image formed on the recording sheet S. On the downstream side of the fuser 109 in the conveyance direction of the recording sheet S, there are disposed a sheet discharge sensor 110 for detecting a conveyance state of a sheet discharging unit, a sheet discharging roller 111 for discharging the recording sheet S, and a stacking tray 112 for stacking the recording sheets S after the recording is completed. Conveyance reference of the recording sheet S is set to be the center of a length of the recording sheet S in the direction orthogonal to the conveyance direction of the image forming apparatus, namely a width of the recording sheet S.

The laser scanner unit 107 includes a laser unit 113 for emitting a laser beam modulated based on an image signal (image signal VDO) sent from an external device 131, described later. In addition, the laser scanner unit 107 includes a polygon motor 114 for scanning a photosensitive drum 117, described later, with the laser beam from the laser unit 113, an imaging lens 115, a reflection mirror 116, and the like. The image forming unit 108 includes the photosensitive drum 117, a primary charging roller 119, a developing unit 120, a transfer charging roller 121, a cleaner 122, and the like, which are necessary for the known electrophotographic process.

The fuser 109 includes a fixing film 109*a*, a pressure roller 109*b*, a ceramic heater 109*c* (hereinafter referred to also as a "heater 109*c*") disposed inside the fixing film 109*a*, and a thermistor 109*d* that is a temperature detection element for detecting the surface temperature of the ceramic heater. In addition, in this embodiment, a main motor 123 drives the sheet feed roller 105 via a sheet feed roller clutch 124 and drives the registration roller pair 106 via a registration roller 125. Further, the main motor 123 also drives individual units of the image forming unit 108 including the photosensitive drum 117, and drives the fuser 109 and the sheet discharging roller 111.

An engine controller 126 performs control of an image forming process by the laser scanner unit 107, the image forming unit 108, and the fuser 109, conveyance control of the recording sheet, and the like. Note that, the engine controller 126 includes a CPU inside and controls the image formation and the like. Further, the CPU includes a ROM and a RAM (not shown). The ROM is a memory storing a program and data for controlling the image formation. In addition, the RAM is a memory that is used for temporarily storing information by a control program executed by the CPU.

A video controller 127 is connected to the external device 131, such as a personal computer, via a general-purpose external interface (such as a Centronics interface or RS232C). The video controller 127 extends image information received from the external device 131 via the external interface into bit data. Then, the video controller 127 sends out the extended bit data as the image signal (image signal VDO) to the engine controller 126 via an internal interface. Further, the video controller 127 includes a data storage unit 133 including a hard disk drive or the like, for example, and stores the image information in the data storage unit 133 as necessary. The video controller 127 also includes a CPU, a ROM, and a RAM inside similarly to the engine controller 126, as a control unit, so as to perform control of data transmission and reception via the interface and control of the data storage unit 133. In addition, it is possible to integrate the engine controller 126 and the video controller 127 so as to be controlled by one CPU. An air-cooled fan 129 is used for air cooling and keeping the inside of the main body 100 at higher pressure than the outside.

Figure 10:
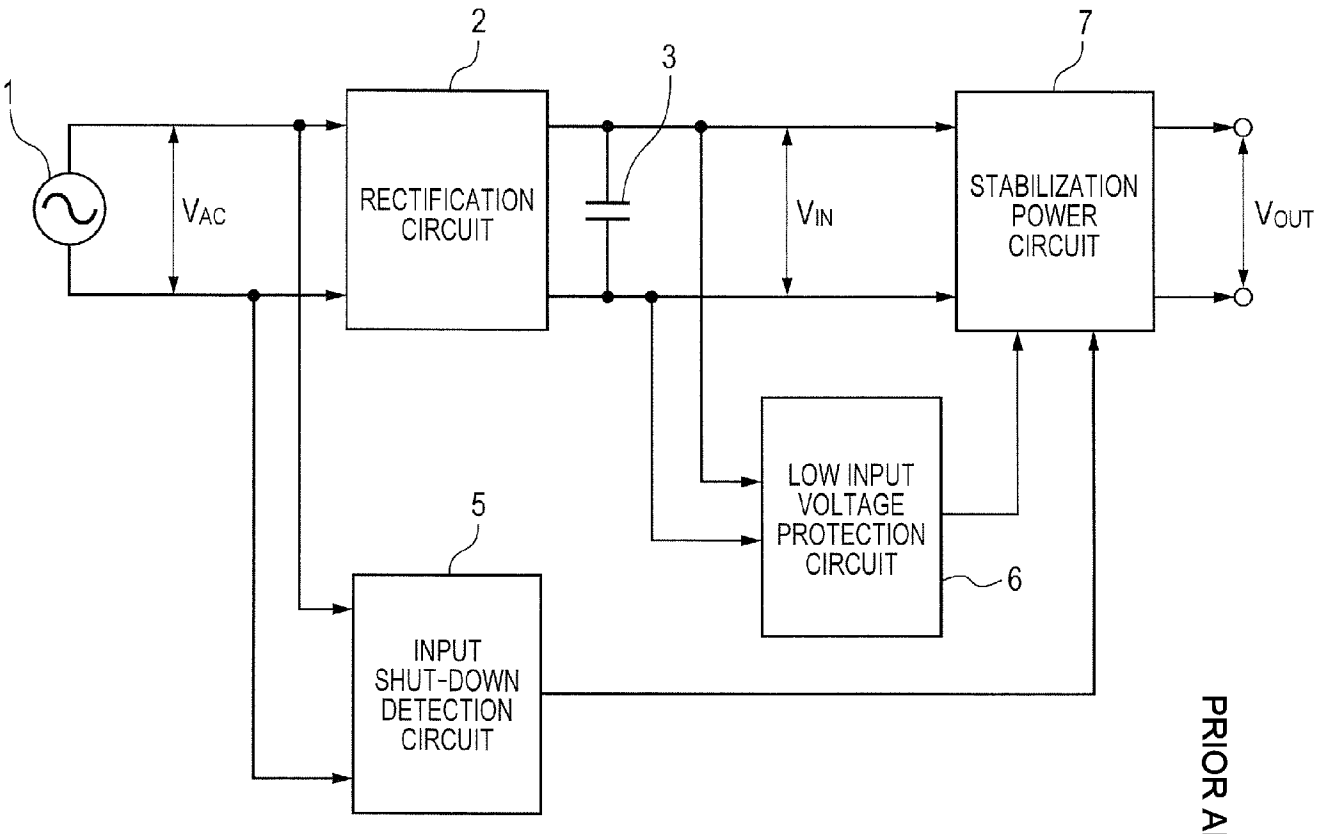
FIG. 10 is a functional block diagram of a switching power supply according to a conventional example.

A power circuit unit 132 is a switching power supply, which is supplied with power from a commercial AC power supply, generates a DC voltage necessary for the units inside the main body 100, and supplies the DC voltage to loads such as devices and circuits inside the main body 100. The power circuit unit 132 includes the low input voltage protection circuit (not shown) described with reference to FIG. 10, in order to prevent excessive current over the rated current value due to an overcurrent state of switching current and breakdown of components due to abnormal heating of a circuit component. When detecting that the input voltage from the commercial AC power supply drops, the low input voltage protection circuit stops supply of power from the power circuit unit 132 to the devices and circuits inside main body 100.

(Outline of Fuser 109)

Figure 1B:
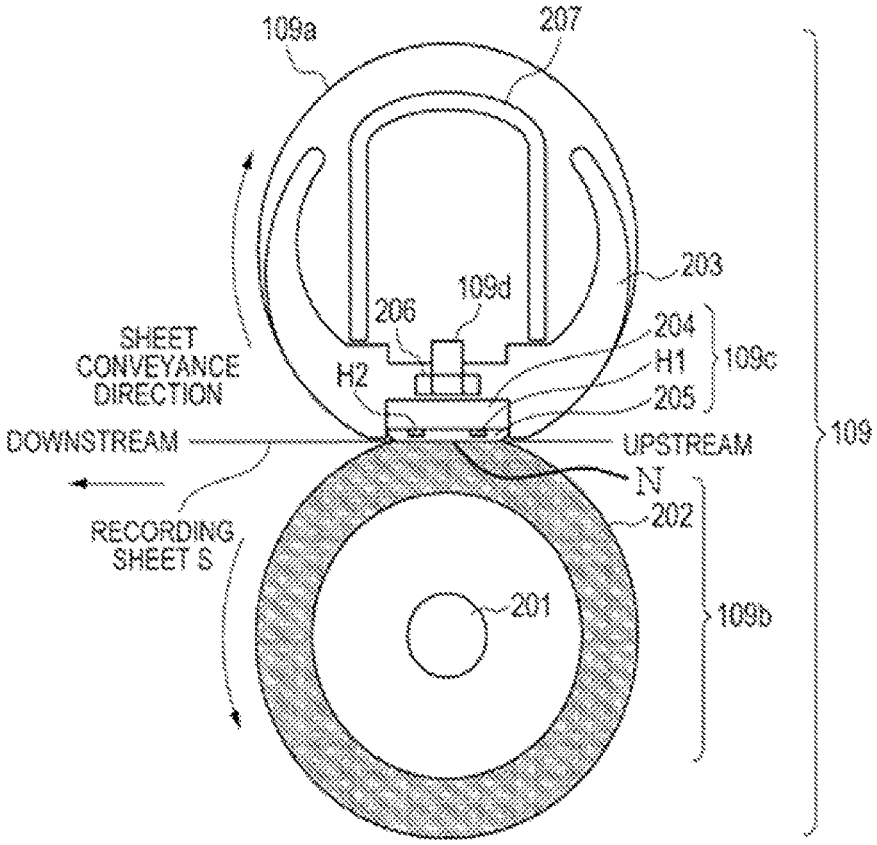
FIG. 1B illustrates a cross-sectional view of a heating apparatus of the image forming apparatus according to the first and second embodiments.

FIG. 1B is a cross-sectional view of the fuser 109 as the heating apparatus. The fuser 109 includes the cylindrical film (or a cylindrical belt) 109*a* as a heating member and the pressure roller 109*b* as a pressing member that forms a fixing nip portion N together with the heater 109*c* via the film 109*a*. Further, the heater 109*c* is disposed in contact with the inner surface of the film 109*a*. As a material of a base layer of the film 109*a*, it is possible to use a high-temperature resin such as polyimide or a metal such as stainless steel. The pressure roller 109*b* includes a core 201 made of iron or aluminum, and an elastic layer 202 made of silicone rubber or the like. The heater 109*c* is supported by a support member 203 made of a high-temperature resin. The support member 203 also has a guide function for guiding rotation of the film 109*a*. The pressure roller 109*b* is driven by a motor (not shown) to rotate in an arrow direction. When the pressure roller 109*b* rotates, the film 109*a* is also rotated in the arrow direction.

The heater 109*c* includes a heater substrate 204 made of ceramic, heat generating members H1 and H2 made of heating resistors on the heater substrate 204, and an insulating surface protection layer 205 (glass in this embodiment) covering the heat generating members H1 and H2. The thermistor 109*d*, which is the temperature detection element contacts a sheet passing region on the backside of the heater substrate 204, through which a minimum size sheet that can be used in the image forming apparatus (for example, an envelope size (having a width of 110 mm) in this embodiment) passes. The power supplied from the commercial AC power supply to the heat generating members H1 and H2 is controlled in accordance with detection temperature by the thermistor 109*d*. The recording sheet S bearing a toner image is sandwiched and conveyed by the fixing nip portion N formed by a nip portion forming member including the heater substrate 204, including the heat generating members H1 and H2 and the surface protection layer 205, and the elastic layer 202 in the sheet conveyance direction. Then, the recording sheet S is heated and processed as the fixing process. The backside of the heater substrate 204 also contacts an element 206 such as a thermo switch, which operates when the temperature of the heater 109*c* rises abnormally, so as to disconnect a power feed line to the heat generating members H1 and H2. Similarly to the thermistor 109*d*, the element 206 also contacts the sheet passing region of the minimum size sheet. A metal stay 207 exerts pressure of a spring (not shown) on the support member 203.

(Outline of Ceramic Heater Control)

Figure 2:
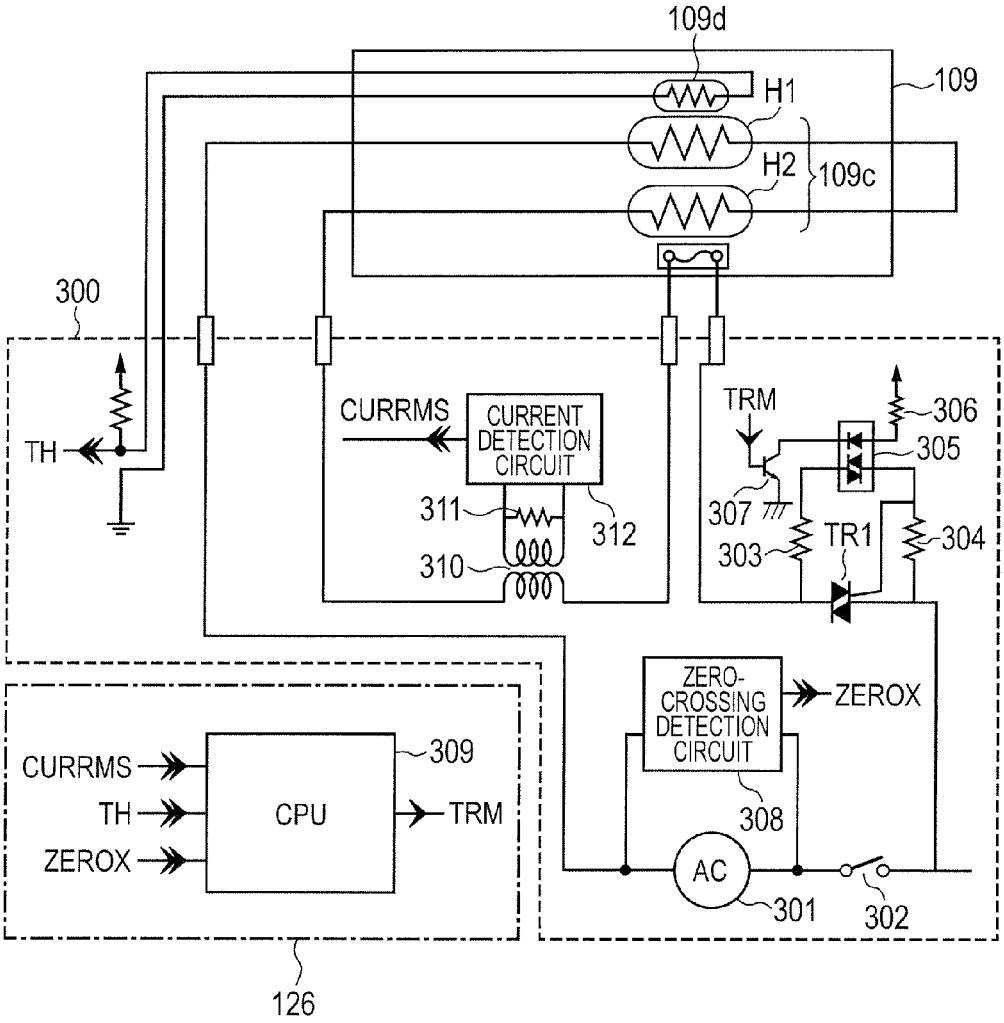
FIG. 2 is a diagram illustrating a circuit structure for controlling drive of a ceramic heater according to the first and second embodiments.

FIG. 2 is a diagram illustrating a circuit structure for controlling drive of the ceramic heater 109*c* of the fuser 109 according to this embodiment. In FIG. 2, a heater drive control circuit 300 (broken line portion) is a circuit for controlling drive of the ceramic heater 109*c*. A commercial AC power supply (AC) 301 connected to the image forming apparatus supplies power to the heat generating members H1 and H2 constituting the ceramic heater 109*c* via a relay 302, and thus the heat generating members H1 and H2 generate heat. The supply of power to the heat generating members H1 and H2 is controlled by on/off of a triac TR1. Resistors 303 and 304 are bias resistors for the triac TR1. A photo triac coupler 305 is a device for securing a creepage distance between primary and secondary sides. When current flows in a light emission diode of the photo triac coupler 305, the triac TR1 is turned on so that power is supplied to the heat generating members H1 and H2. A resistor 306 is a resistor for limiting current to the photo triac coupler 305. A transistor 307 turns on and off the photo triac coupler 305. The transistor 307 operates in accordance with a TRM signal output from a CPU 309 inside the engine controller 126 (dot-dashed line portion). When a TRM signal applied to a base terminal of the transistor 307 becomes the high level so that the transistor 307 enters the ON state and current flows in the light emission diode of the photo triac coupler 305, the triac TR1 is turned on so that power is supplied to the heat generating members H1 and H2. When the TRM signal applied to the base terminal of the transistor 307 changes from the high level to the low level, the transistor 307 enters the OFF state so that current does not flow in the light emission diode of the photo triac coupler 305. While the power from the commercial AC power supply (AC) 301 is supplied to the triac TR1, that is, until no current flows and the input voltage becomes 0 V, the ON state of the triac TR1 continues so that the power is supplied to the heat generating members H1 and H2.

In addition, the input voltage of the commercial AC power supply (AC) 301 is supplied also to a zero-crossing detection circuit 308. When the zero-crossing detection circuit 308 detects that the input voltage of the commercial AC power supply is a certain threshold value or lower, the zero-crossing detection circuit 308 outputs a pulse signal (hereinafter referred to as a "ZEROX signal") to the CPU 309 in the engine controller 126. The CPU 309 detects a rising edge or a falling edge of a pulse of the ZEROX signal and outputs the TRM signal at a timing based on phase control or wave number control, to thereby control the turning on/off of the triac TR1.

The heater current flowing in the heat generating members H1 and H2 when the triac TR1 is in the ON state is converted into a voltage by a current transformer 310 and is supplied to a current detection circuit 312 via a bleeder resistor 311. The current detection circuit 312 converts the voltage-converted heater current waveform into an average value or a root-mean-square value of current, which is supplied to the CPU 309 as a CURRMS signal.

The temperature of the ceramic heater 109*c* is detected by the thermistor 109*d* and is supplied to the CPU 309 as a TH signal. The CPU 309 compares the temperature indicated by the TH signal with a target temperature of the ceramic heater 109*c*. Then, the CPU 309 calculates a supply power ratio that is a ratio between power obtained when the entire power supply voltage of the commercial AC power supply is supplied to the heat generating members H1 and H2 of the ceramic heater 109*c* and power to be supplied to the heat generating members H1 and H2 based on the comparison result. Then, the calculated supply power ratio is converted into the corresponding phase angle (in the case of phase control) or into the corresponding wave number (in the case of wave number control). Based on the phase control or the wave number control, the CPU 309 outputs the TRM signal to the transistor 307 so as to control on/off of the triac TR1.

<Heat Control of Image Forming Apparatus>

Heat control of the fuser 109 is performed by one of the phase control, the wave number control, and hybrid control in which the phase control and the wave number control are combined. These three types of heat control methods are described below.

(1) Heat Control by Phase Control

The case where the heat control of the fuser 109 is performed by the phase control is described. In the case of the phase control, for example, Table 1 in which a power ratio (duty D %) supplied to the heater and a phase angle (α degrees) are associated with each other is stored in the ROM of the CPU 309. Based on contents of Table 1, the CPU 309 performs the heat control of the fuser 109.

TABLE 1

| Supply power ratio Duty ratio D (%) | Phase angle α (°) |
|---|---|
| 100 | 0 |
| 97.5 | 28.56 |
| . | . |
| . | . |
| . | . |
| 90 | 46.6 |

TABLE 1-continued

| Supply power ratio Duty ratio D (%) | Phase angle α (°) |
|---|---|
| . | . |
| . | . |
| . | . |
| 75 | 66.17 |
| . | . |
| . | . |
| . | . |
| 55 | 85.49 |
| . | . |
| . | . |
| . | . |
| 50 | 90 |
| . | . |
| . | . |
| . | . |
| 45 | 94.51 |
| . | . |
| . | . |
| . | . |
| 25 | 113.83 |
| . | . |
| . | . |
| . | . |
| 2.5 | 151.44 |
| 0 | 180 |

The amount of heat to be applied to the fuser 109 is calculated based on the target temperature to be reached and the temperature detected by the thermistor 109*d* every time the ZEROX signal is output from the zero-crossing detection circuit 308. In this embodiment, PI control that is one type of feedback control is used for description. The PI control is proportional control plus integral control for determining the duty D of the power to be supplied to the heater 109*c* (supply power ratio D). Then, in accordance with the determined duty D, the CPU 309 of the engine controller 126 turns on and off the triac TR1 as a switching element by the phase control so as to perform more accurate temperature adjustment.

Figure 3A:
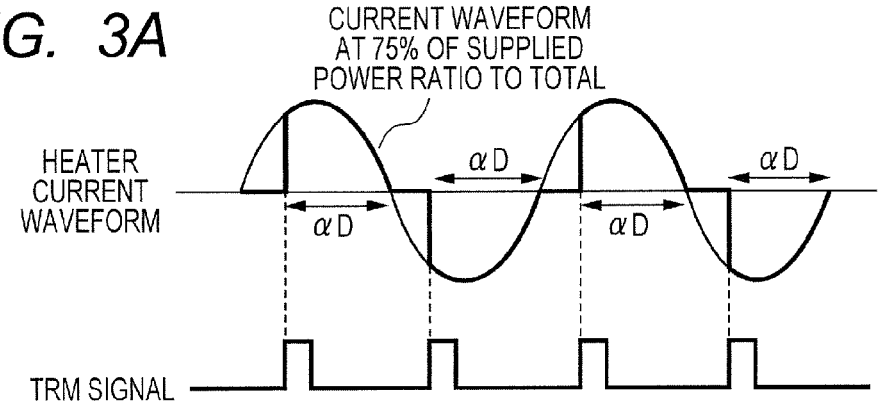
FIGS. 3A, 3B, and 3C are diagrams illustrating waveforms of current flowing in the ceramic heater according to the first embodiment.
Figure 3B:
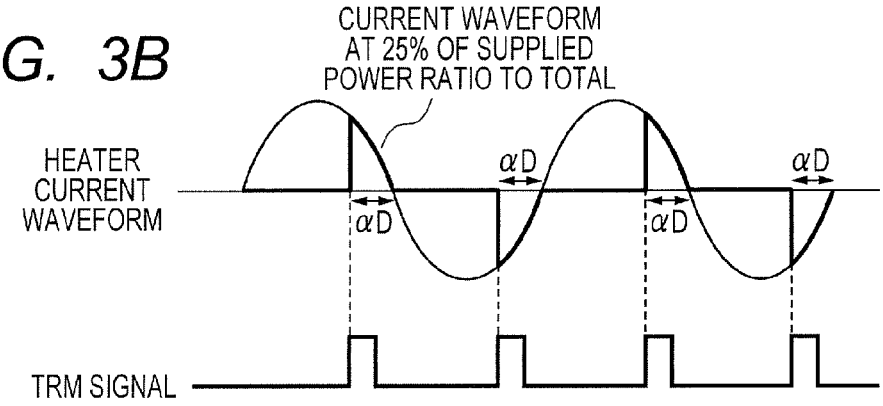

FIGS. 3A and 3B are diagrams illustrating a waveform of the heater current flowing in the heater 109*c* in accordance with the supply power ratio D (illustrated by a thick solid line) and the TRM signal, in which αD represents a phase angle corresponding to the supply power ratio D. FIG. 3A illustrates the waveform of the heater current when the supply power ratio D is 75%, and FIG. 3B illustrates the waveform of the heater current when the supply power ratio D is 25%.

In FIG. 3A, the CPU 309 changes the TRM signal to the high level at the timing when the supply power ratio D becomes 75%. As a result, when the transistor 307 enters the ON state so that current flows in the light emission diode of the photo triac coupler 305, the triac TR1 is turned on. As shown in Table 1, the phase angle α is 66.17 degrees when the supply power ratio D is 75%. Therefore, the CPU 309 changes the TRM signal to the high level at the timing when the phase angle α becomes 66.17 degrees. When the TRM signal becomes the high level, the triac TR1 enters the ON state so that the supply of power to the ceramic heater 109*c* is started. The current continues to be fed to the triac TR1 until a zero-cross point at which the input voltage becomes 0 V, and the current waveform of the heater 109*c* becomes the waveform illustrated in FIG. 3A.

In FIG. 3B, similarly to FIG. 3A, the CPU 309 changes the TRM signal to the high level at the timing when the supply power ratio D becomes 25%, and turns on the triac TR1. As shown in Table 1, the phase angle α is 113.83 degrees when the supply power ratio D is 25%. Therefore, the CPU 309 changes the output of the TRM signal to the high level at the timing when the phase angle α becomes 113.83 degrees.

The supply power ratio D using the PI control in this embodiment is calculated by the following Expression (1).

$$\text{supply power ratio } D = P \text{ control value} + I \text{ control value} \quad (1)$$

The supply power ratio D is controlled by 1.25% increments in a manner that a half-wave as a half period of the current waveform is divided by 80. The P control value in Expression (1) is a control value for the proportional control and is determined by Expression (2) in this embodiment.

$$P \text{ control value} = Kp \times \Delta T \quad (2)$$

In Expression (2), Kp represents a proportional gain, which is determined to be an appropriate value considering temperature overshoot and temperature stability. In addition, ΔT represents a difference between the target temperature of the heater 109*c* and the detection temperature by the thermistor 109*d*, which is calculated by subtracting the current detection temperature from the target temperature.

The I control value in Expression (1) is a control value for the integral control, which corrects the integral of ΔT during a certain period, namely a drift from the target temperature value, which is given as an offset to the supply power ratio D in the P control. In this embodiment, the CPU 309 of the engine controller 126 includes a counter to integrate a history of a comparative relationship between the target temperature of the heater 109*c* and the detection temperature by the thermistor 109*d*. The CPU 309 determines the comparative relationship between the target temperature and the detection temperature every 100 msec. When the target temperature is higher, the CPU 309 increments the counter. When the target temperature is lower, the CPU 309 decrements the counter. As a result, when the counter becomes 6 or larger, the CPU 309 increments the I control value and resets the counter. When the counter becomes −6 or smaller, the CPU 309 decrements the I control value and resets the counter.

In addition, when the CPU 309 calculates the supply power ratio D of power to be supplied to the heat generating members H1 and H2, the CPU 309 calculates an upper limit supply power ratio based on the CURRMS signal output from the current detection circuit 312. Further, the CPU 309 performs the control so as to supply the heater 109*c* with power of a maximum suppliable power ratio Dmax or lower, which is the upper limit supply power ratio. The maximum suppliable power ratio Dmax is calculated by the following Expression (3), using a current value Irms output as the CURRMS signal from the current detection circuit 312, a supply power ratio D input based on the detection result by the thermistor 109*d*, and a maximum suppliable current value Ilimit.

$$D\text{max} = (I\text{limit}/I\text{rms})^2 \times D \quad (3)$$

Note that, in Expression (3), the maximum suppliable current value Ilimit indicates an allowable current value that can be supplied to the heater 109*c*, which is calculated by subtracting a maximum current value supplied to the power circuit unit 132 from the rated current value of the commercial AC power supply connected to the main body 100. For instance, in the case where the commercial AC power supply is a 100 V system, the maximum suppliable current value Ilimit is 10 A, which is calculated by subtracting the maximum current value 5 A supplied to the power circuit unit 132 from the rated current value 15 A of the commercial AC power supply.

Figure 3C:
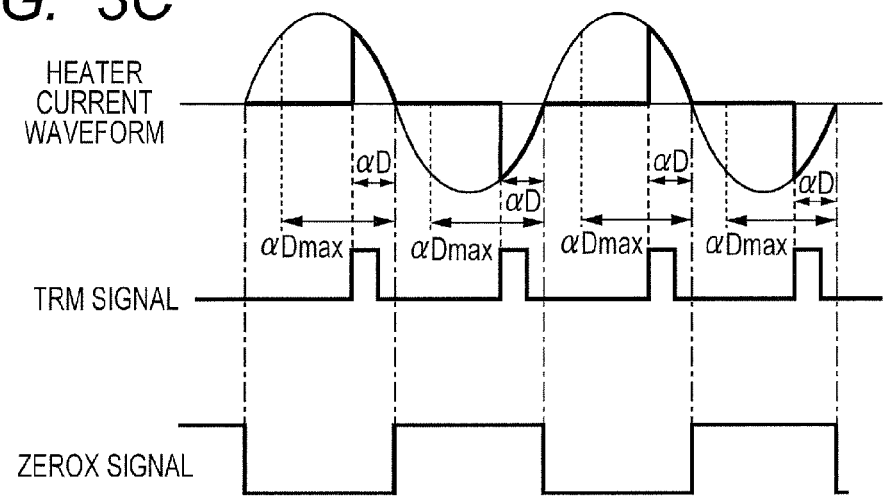

FIG. 3C is a diagram illustrating a waveform of the heater current flowing in the heater 109*c* in accordance with the supply power ratio D (illustrated by a thick solid line), the TRM signal, and the ZEROX signal, in which αD represents a phase angle corresponding to the supply power ratio D, and ΔDmax represents a phase angle corresponding to the maximum suppliable power ratio Dmax. A waveform of the ZEROX signal in the lower part of FIG. 3C is a zero-cross signal output as a pulse signal to the CPU 309, in order that the zero-crossing detection circuit 308 notify that the input voltage of the commercial AC power supply becomes a voltage of a certain threshold value or lower.

The CPU 309 calculates the supply power ratio D of power to be supplied to the heat generating members H1 and H2 of the ceramic heater 109*c* based on the temperature detected by the thermistor 109*d*. The CPU 309 converts the calculated supply power ratio D into the corresponding phase angle by using the above-mentioned Table 1. Then, the CPU 309 uses a rising edge or a falling edge of the zero-cross signal as synchronizing timing so as to change the output of the TRM signal to the high level in synchronization with timing of the converted phase angle.

The CPU 309 can calculate the maximum suppliable power ratio Dmax by Expression (3). In the phase control of this embodiment, supply of power by the phase angle αD exceeding the phase angle αDmax corresponding to the maximum suppliable power ratio Dmax is inhibited. Therefore, a phase control range is from ΔDmax to 180 degrees, and a range of the supply power ratio D is 0% (when the phase angle is 180 degrees) to Dmax (when the phase angle is ΔDmax).

(2) Heat Control by Wave Number Control

Figure 4:
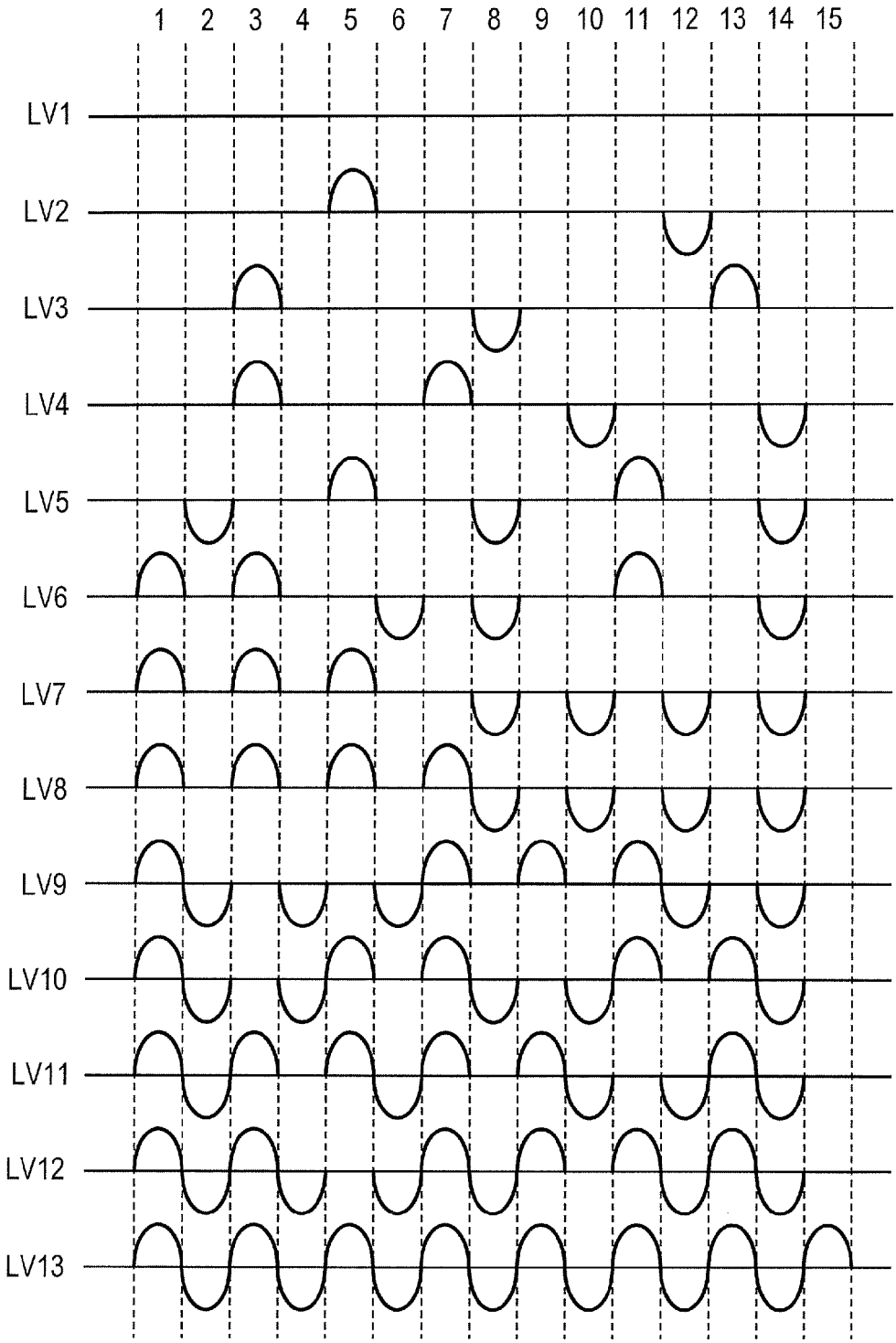
FIG. 4 is a diagram illustrating a power supply pattern to the heater in wave number control according to the first and second embodiments.

The case where the heat control of the fuser 109 is performed by the wave number control is described. In the wave number control, feed current control is performed by a half-wave of the AC power supply. FIG. 4 is a diagram illustrating a power supply pattern to the heater 109*c* in the wave number control, in which the vertical axis represents a control level (LV1 to LV13), and the horizontal axis represents a power supply pattern. The half-wave portion illustrated by a solid line indicates a period of time while the power is supplied to the heater 109*c*. In the case of the wave number control, control pattern data for turning on and off the supply of power to the heater 109*c* by a half-wave as illustrated in FIG. 4, for example, is stored in the ROM in the CPU 309. Based on the control pattern of FIG. 4, the CPU 309 performs the heat control of the fuser 109. In the example of FIG. 4, one control period of the wave number control corresponds to 15 half-wave periods. In FIG. 4, the half-wave is indicated by 1 to 15. Therefore, an amount of power to be supplied to the heater 109*c* of the fuser 109 is calculated for every 15 half-wave periods as the control period based on the target temperature to be reached and the temperature detected by the thermistor 109*d*. In the wave number control, similarly to the case of the phase control, the duty D of the power to be supplied to the heater 109*c* (supply power ratio D) is determined by the PI control. Then, in accordance with the determined duty D, the CPU 309 of the engine controller 126 turns on and off the triac TR1 by the wave number control so as to perform more accurate temperature adjustment.

The supply power ratio D in the wave number control is calculated by Expression (1) similarly to the case of the phase control. Then, the calculated supply power ratio D is converted into a control level (LV1 to LV13) in which one control period is divided into 13 control patterns, and the temperature control is performed based on the control level.

The maximum suppliable power ratio Dmax in the wave number control is calculated by the above-mentioned Expression (3) similarly to the case of the phase control. In other words, the maximum suppliable power ratio Dmax is calculated by Expression (3) using the current value Irms output as the CURRMS signal from the current detection circuit 312, the supply power ratio D input based on the detection result by the thermistor 109*d*, and the maximum suppliable current value Ilimit. Note that, in the case of the wave number control, the current value Irms in Expression (3) is an average value in the 15 half-wave periods as the control period. Therefore, it is necessary for the CPU 309 to store the current values Irms output as the CURRMS signals from the current detection circuit 312 in the 15 half-wave periods, and to calculate an average value of the current values Irms.

(3) Heat Control by Hybrid Control

The case where the heat control of the fuser 109 is performed by the hybrid control is described. The hybrid control is control in which the above-mentioned phase control and wave number control are combined. In the hybrid control of this embodiment, in a set of two half-wave periods, the feed current control is performed by the same phase angle for the one set of half-wave periods. Table 2 is an example of a table in which a control level in the hybrid control, a power ratio (%) of power to be supplied to the heater 109*c*, and a power ratio in each half-wave of the control period are associated with each other. The CPU 309 stores Table 2 in the ROM and performs the heat control of the fuser 109 based on contents of Table 2. As shown in Table 2, the control LV (control level) corresponding to the ratio of power to be supplied to the heater 109*c* includes 41 steps of LV0 to LV40. The CPU 309 determines the control LV in accordance with the ratio of power to be supplied. In the example of Table 2, the control period of the hybrid control is set as 4 full-wave (namely, 8 half-wave) periods, and Table 2 shows the 8 half-wave periods as count 1 to count 8. Therefore, an amount of power to be supplied to the heater 109*c* of the fuser 109 is calculated for every 4 full-wave (namely, 8 half-wave) periods as the control period based on the target temperature to be reached and the temperature detected by the thermistor 109*d*. As shown in Table 2, in the hybrid control, fine supply of power to the heater 109*c* can be performed for each half-wave (count 1 to count 8).

Figures 5A, 5B:
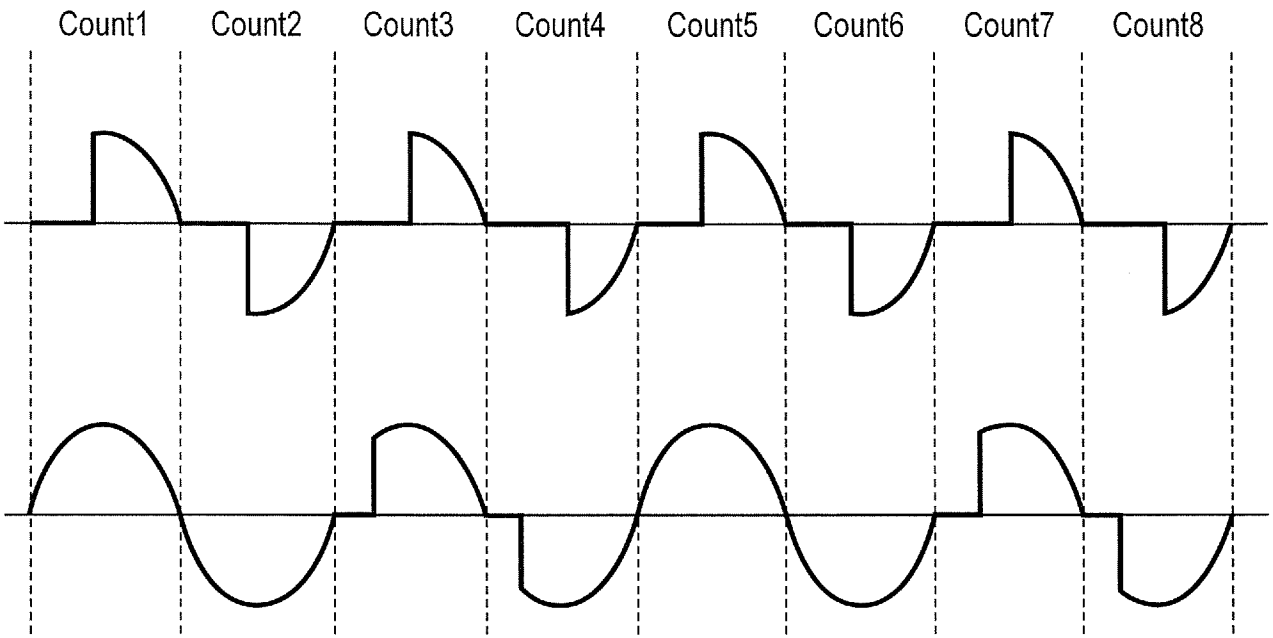
FIGS. 5A and 5B are diagrams illustrating waveforms of current flowing in the heater in hybrid control according to the first and second embodiments.

FIGS. 5A and 5B are diagrams illustrating waveforms of current flowing in the heater 109*c* in the hybrid control. FIG. 5A illustrates a current waveform when the control LV is level 20 (LV20), and FIG. 5B illustrates a current waveform when the control LV is level 38 (LV38). The power ratio when the control LV is level 20 as illustrated in FIG. 5A is 50% as shown in Table 2. In the 8 half-wave periods from count 1 to count 8 of the control period, the supply of power having power ratios of 55%, 55%, 45%, 45%, 55%, 55%, 45%, and 45% is performed. The phase angles when the power ratio is 55% and 45% are 85.49 degrees and 94.51 degrees, respectively, as shown in Table 1. As illustrated in FIG. 5A, the CPU 309 performs the feed current control so that the heater 109*c* is supplied with power at timings when the phase angle becomes 85.49 degrees and 94.51 degrees. The power ratio when the control LV is level 38 as illustrated in FIG. 5B is 95% as shown in Table 2. In the 8 half-wave periods from count 1 to count 8 of the control period, the supply of power having power ratios of 100%, 100%, 90%, 90%, 100%, 100%, 90%, and 90% is performed. The phase angles when the power ratio is 100% and 90% are 0 degrees and 46.6 degrees, respectively, as shown in Table 1. As illustrated in FIG. 5B, the CPU 309 performs the feed current control so that the heater 109*c* is supplied with power at timings when the phase angle becomes 0 degrees and 46.6 degrees.

The supply power ratio D in the hybrid control is calculated by Expression (1) similarly to the cases of the phase control and the wave number control. Then, the calculated supply power ratio D is converted into control levels (LV0 to LV40) obtained by dividing the control period into 41 control patterns. Based on the control level, the temperature control is performed.

The maximum suppliable power ratio Dmax in the hybrid control is calculated by the above-mentioned Expression (3) similarly to the cases of the phase control and the wave number control. In other words, the maximum suppliable power ratio Dmax is calculated by Expression (3) using the current value Irms output as the CURRMS signal from the

TABLE 2

| Control LV | Power ratio [%] | Count 1 | Count 2 | Count 3 | Count 4 | Count 5 | Count 6 | Count 7 | Count 8 |
|---|---|---|---|---|---|---|---|---|---|
| LV0 | 0.0% | 0% | 0% | 0% | 0% | 0% | 0% | 0% | 0% |
| LV1 | 2.5% | 0% | 0% | 10% | 0% | 0% | 10% | 0% | 0% |
| LV2 | 5.0% | 0% | 0% | 20% | 0% | 0% | 20% | 0% | 0% |
| . | . | . | . | . | . | . | . | . | . |
| . | . | . | . | . | . | . | . | . | . |
| . | . | . | . | . | . | . | . | . | . |
| LV9 | 22.5% | 27.5% | 27.5% | 17.5% | 17.5% | 27.5% | 27.5% | 17.5% | 17.5% |
| LV10 | 25.0% | 30% | 30% | 20% | 20% | 30% | 30% | 20% | 20% |
| LV11 | 27.5% | 32.5% | 32.5% | 22.5% | 22.5% | 32.5% | 32.5% | 22.5% | 22.5% |
| . | . | . | . | . | . | . | . | . | . |
| . | . | . | . | . | . | . | . | . | . |
| . | . | . | . | . | . | . | . | . | . |
| LV19 | 47.5% | 52.5% | 52.5% | 42.5% | 42.5% | 52.5% | 52.5% | 42.5% | 42.5% |
| LV20 | 50.0% | 55% | 55% | 45% | 45% | 55% | 55% | 45% | 45% |
| LV21 | 52.5% | 57.5% | 57.5% | 47.5% | 47.5% | 57.5% | 57.5% | 47.5% | 47.5% |
| . | . | . | . | . | . | . | . | . | . |
| . | . | . | . | . | . | . | . | . | . |
| . | . | . | . | . | . | . | . | . | . |
| LV29 | 72.5% | 77.5% | 77.5% | 67.5% | 67.5% | 77.5% | 77.5% | 67.5% | 67.5% |
| LV30 | 75.0% | 80% | 80% | 70% | 70% | 80% | 80% | 70% | 70% |
| LV31 | 77.5% | 82.5% | 82.5% | 72.5% | 72.5% | 82.5% | 82.5% | 72.5% | 72.5% |
| . | . | . | . | . | . | . | . | . | . |
| . | . | . | . | . | . | . | . | . | . |
| . | . | . | . | . | . | . | . | . | . |
| LV38 | 95.0% | 100% | 100% | 90% | 90% | 100% | 100% | 90% | 90% |
| LV39 | 97.5% | 100% | 100% | 95% | 95% | 100% | 100% | 95% | 95% |
| LV40 | 100.0% | 100% | 100% | 100% | 100% | 100% | 100% | 100% | 100% |

current detection circuit 312, the supply power ratio D input based on the detection result by the thermistor 109*d*, and the maximum suppliable current value Ilimit. Note that, in the case of the hybrid control, the current value Irms in Expression (3) is an average value in the 4 full-wave (namely, 8 half-wave) periods as the control period. Therefore, it is necessary for the CPU 309 to store the current values Irms output as the CURRMS signals from the current detection circuit 312 in the 8 half-wave periods, and to calculate the average value of the current values Irms.

As described above, the phase control, the wave number control, and the hybrid control are described as the heat control methods for the fuser 109. In each control method, the circuit illustrated in FIG. 2 is used, the supply power ratio D is calculated by Expression (1), and the maximum suppliable power ratio Dmax is calculated by Expression (3). In the following description, the phase control is exemplified, and the case of wave number control or hybrid control is described as necessary. Here, the number of half-wave periods as the control period is different depending on the control method. Therefore, the current value Irms used in Expression (3) is different depending on the control method. In the case of the phase control, the current value measured every half-wave is used. In the case of the wave number control or the hybrid control, an average value of current values in the control period is used.

<Method of Detecting Input Voltage Drop of Commercial AC Power Supply>

Figure 6A:
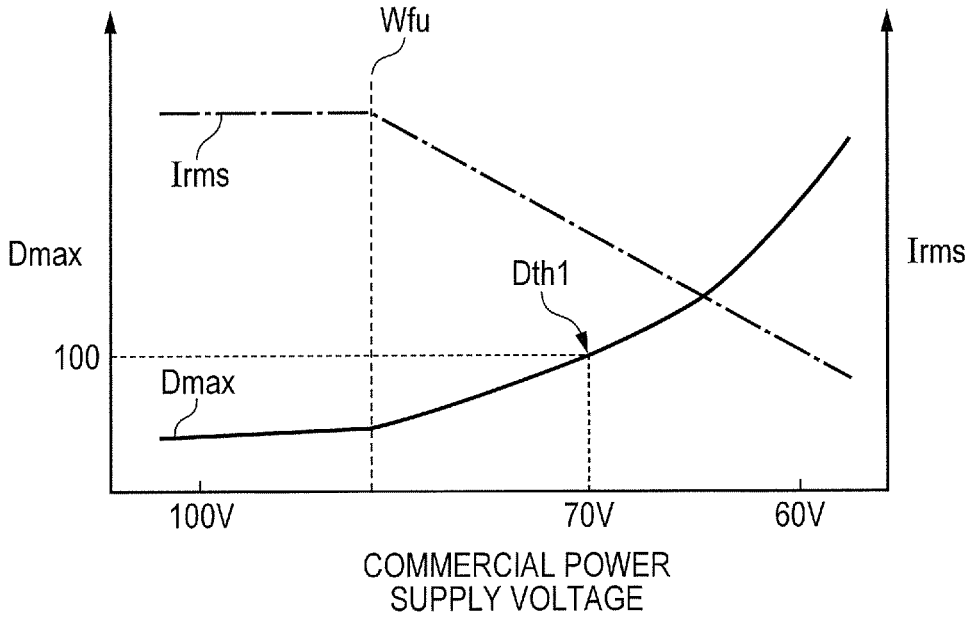
FIGS. 6A and 6B are diagrams showing a method of detecting an input voltage drop of a commercial AC power supply according to the first embodiment.
Figure 6B:
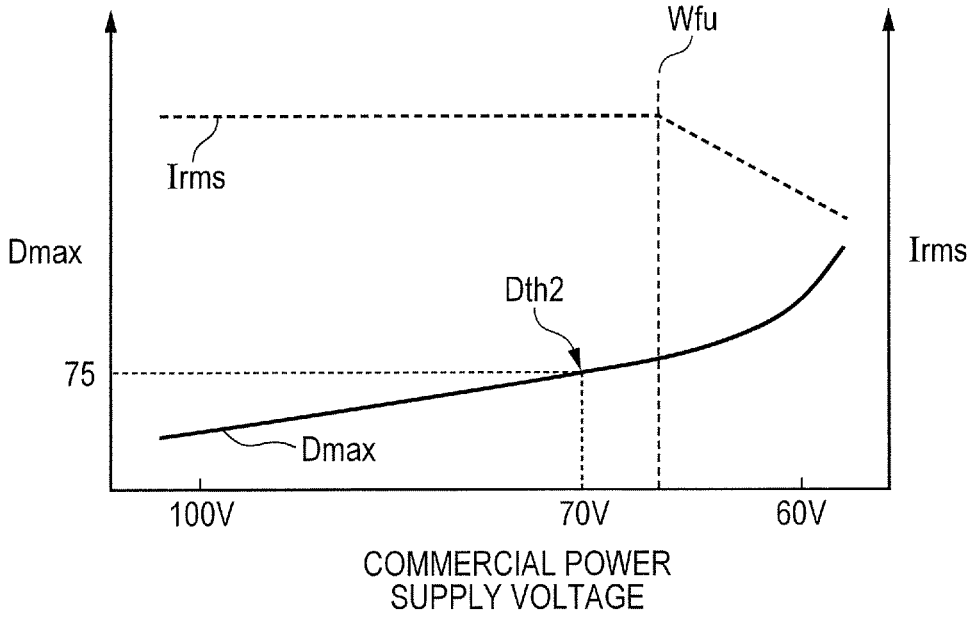

FIGS. 6A and 6B are diagrams illustrating a method of detecting the input voltage drop of the commercial AC power supply. In FIGS. 6A and 6B, the horizontal axis represents the input voltage of the commercial AC power supply, the left vertical axis represents the maximum suppliable power ratio Dmax, and the right vertical axis represents the current value Irms of the heater current detected by the current detection circuit 312. The input voltage drop of the commercial AC power supply in this embodiment needs to be detected before the low input voltage protection circuit of the power circuit unit 132 detects a low voltage. Therefore, detection of the input voltage drop of the commercial AC power supply is performed at a voltage higher than the voltage at which the low input voltage protection circuit detects the low voltage. Therefore, the input voltage of the commercial AC power supply detected as the low voltage by the low input voltage protection circuit of the power circuit unit 132 is set to 60 V. In addition, in FIGS. 6A and 6B, it is supposed that power Wfu necessary for keeping a constant temperature of the heater 109*c* is constant. FIG. 6A shows a relationship among the input voltage of the commercial AC power supply, the maximum suppliable power ratio Dmax, and the current value Irms of the current detection circuit 312 when the necessary power Wfu is large, and FIG. 6B shows the relationship when the necessary power Wfu is small.

The CPU 309 calculates the phase angle from Table 1 so as to keep a constant temperature of the heater 109*c* and outputs the TRM signal to the transistor 307. In other words, the CPU 309 performs control of setting the output of the TRM signal to the high level so that the heater current supplied to the heat generating members H1 and H2 of the ceramic heater 109*c* becomes constant. Therefore, when the input voltage of the commercial AC power supply is a voltage that can supply the power Wfu necessary for keeping a constant temperature of the fuser 109, the current value Irms of the heater current detected by the current detection circuit 312 shown in FIGS. 6A and 6B becomes constant. However, when the input voltage of the commercial AC power supply gradually drops, the CPU 309 needs to gradually increase the current value to be supplied to the heat generating members H1 and H2 in order to keep the constant temperature of the heater 109*c*, namely the constant amount of heat of the heat generating members H1 and H2. Then, in order to gradually increase the current value to be supplied to the heat generating members H1 and H2, the CPU 309 needs to gradually decrease the phase angle α in accordance with Table 1. Along with this, the supply power ratio D is gradually increased. As a result, the current value Irms of the current detection circuit 312 is kept constant, but the supply power ratio D is gradually increased. Therefore, the maximum suppliable power ratio Dmax is gradually increased in accordance with Expression (3). Further, the input voltage of the commercial AC power supply drops to a predetermined voltage or lower, and the heat generating members H1 and H2 cannot be supplied with the constant current. When the heat generating members H1 and H2 cannot be supplied with the necessary power Wfu, the current value Irms of the heater 109*c* detected by the current detection circuit 312 gradually drops. As a result, the maximum suppliable power ratio Dmax is increased along with the drop of the current value Irms in accordance with Expression (3).

FIG. 6A shows the case where the necessary power Wfu is high for keeping a constant temperature of the heater 109*c*. Therefore, compared with FIG. 6B, the current value Irms (dot-dashed line) is decreased even from a high input voltage of the commercial AC power supply. In FIG. 6A, a threshold value Dth1 indicates the maximum suppliable power ratio Dmax when the input voltage of the commercial AC power supply is 70 V, and a value of the maximum suppliable power ratio Dmax in this case is regarded as 100 (first threshold value). When the value of the maximum suppliable power ratio Dmax calculated by Expression (3) becomes the threshold value Dth1 (100) or higher (the first threshold value or higher), the CPU 309 determines that the input voltage of the commercial AC power supply has dropped to 70 V or lower and notifies the video controller 127 of the input voltage drop. Then, when the video controller 127 is notified of the input voltage drop, the video controller 127 stops writing operation in the data storage unit 133.

FIG. 6B shows the case where the necessary power Wfu is low for keeping a constant temperature of the heater 109*c*. Therefore, compared with FIG. 6A, the current value Irms (broken line) is decreased from a low input voltage of the commercial AC power supply. As described above, even when the current value Irms is constant, when the input voltage of the commercial AC power supply gradually drops, the maximum suppliable power ratio Dmax is increased correspondingly. Therefore, the value of the maximum suppliable power ratio Dmax when the input voltage of the commercial AC power supply is 70 V is set as a threshold value Dth2 for detecting the input voltage drop of the commercial AC power supply. Then, the CPU 309 can detect the input voltage drop similarly to FIG. 6A. Here, in the case where the threshold value Dth2 is 75, when the maximum suppliable power ratio Dmax calculated by Expression (3) becomes the threshold value Dth2 (75) or higher, the CPU 309 determines that the input voltage of the commercial AC power supply has dropped to 70 V or lower. Then, the CPU 309 notifies the video controller 127 of the input voltage drop, and the video controller 127 notified of the input voltage drop stops writing operation in the data storage unit 133.

In this way, there is a tendency that, when the input voltage of the commercial AC power supply gradually drops, the maximum suppliable power ratio Dmax is gradually increased because of an increase of the supply power ratio D or a decrease of the current value Irms. Therefore, the CPU 309 can detect that the input voltage of the commercial AC power supply has dropped to be lower than a predetermined voltage, by detecting an increase of the maximum suppliable power ratio Dmax to determine whether or not the detected value is higher than a threshold value Dth. When the CPU 309 detects that the input voltage of the commercial AC power supply has dropped, the CPU 309 can stop the writing operation in the data storage unit 133 by notifying the video controller 127 of the input voltage drop. As described above, the voltage value at which the low input voltage protection circuit of the power circuit unit 132 detects the drop of the input voltage of the commercial AC power supply is lower than the voltage value at which the CPU 309 detects the input voltage drop based on the maximum suppliable power ratio Dmax. Therefore, even when the supply of power from the commercial AC power supply is shut down when the low input voltage protection circuit of the power circuit unit 132 detects the input voltage drop, it is possible to prevent the record data from being damaged in the data storage unit 133.

<Control Sequence for Detecting Input Voltage of Commercial AC Power Supply>

Figure 7:
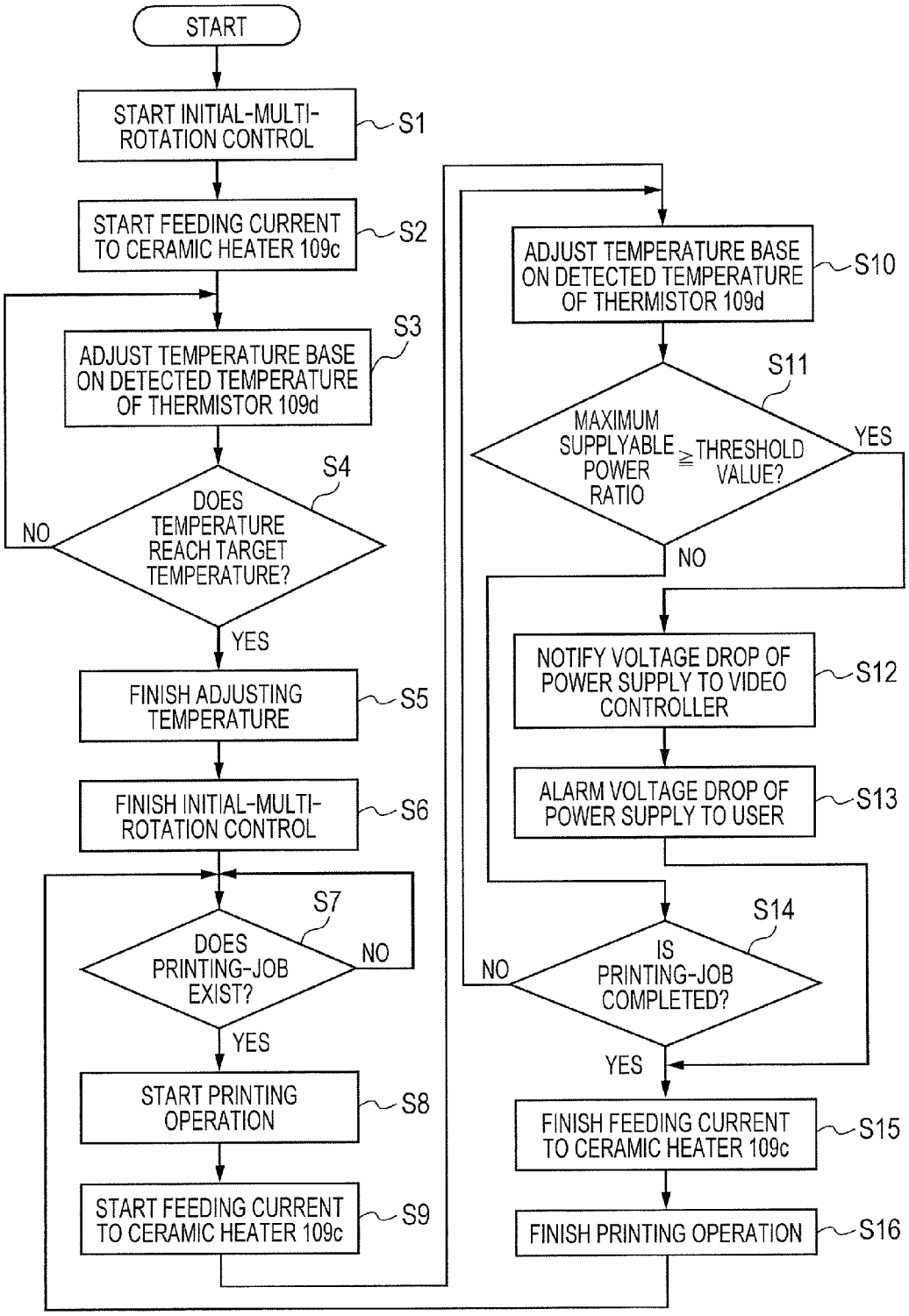
FIG. 7 is a flowchart illustrating a control sequence for detecting the input voltage drop of the commercial AC power supply according to the first embodiment.

A control sequence for detecting the drop of the input voltage of the commercial AC power supply in this embodiment is described below. FIG. 7 is a flowchart illustrating the control sequence for detecting the drop of the input voltage of the commercial AC power supply. The process illustrated in FIG. 7 is performed by the CPU 309 of the engine controller 126 based on a control program stored in the ROM of the CPU 309. Note that, in the following description of the flowchart of FIG. 7, it is supposed that the feed current control of the heater 109*c* is based on the phase control.

First, in Step 1 (hereinafter referred to as S1), a power supply of the image forming apparatus is turned on so that the CPU 309 starts to operate. Then, the CPU 309 controls the main motor of the image forming apparatus to start initial-multi-rotation control for performing preparing operation of necessary process devices. In S2, the CPU 309 starts feeding current to the ceramic heater 109*c*. In S3, the CPU 309 performs temperature adjustment control for raising the temperature of the ceramic heater 109*c* to a predetermined target temperature based on the temperature detected by the thermistor 109*d*. In S4, when the CPU 309 determines that the detection temperature of the thermistor 109*d* has reached a predetermined target temperature as an end condition of the initial-multi-rotation control, the process proceeds to S5, and, when the CPU 309 determines that the detection temperature has not reached the target temperature, the process returns to S3. In S5, the CPU 309 finishes the temperature adjustment control because the temperature of the ceramic heater 109*c* has reached the target temperature. In S6, the CPU 309 finishes the initial-multi-rotation control and proceeds to a standby state.

In S7, the CPU 309 determines whether or not a printing-job exists. The CPU 309 repeats the process of S7 when the printing-job does not exist, and when the printing-job exists, the process proceeds to S8. In S8, the CPU 309 starts printing operation. In S9, the CPU 309 starts feeding current to the ceramic heater 109*c* in order to set the temperature of the ceramic heater 109*c* to a temperature appropriate for image formation. In S10, the CPU 309 performs temperature adjustment control of the ceramic heater 109*c* based on the detection temperature by the thermistor 109*d*.

In S11, the CPU 309 calculates the current value Irms of the heater current flowing in the ceramic heater 109*c* based on the CURRMS signal output from the current detection circuit 312. In addition, the CPU 309 calculates the current supply power ratio D to the ceramic heater 109*c* by Expression (1) based on the temperature detection result of the thermistor 109*d*. Then, the CPU 309 calculates the maximum suppliable power ratio Dmax by Expression (3) using the calculated current value Irms, the supply power ratio D, and the maximum suppliable current value Ilimit. Next, the CPU 309 determines whether or not the calculated value of the maximum suppliable power ratio Dmax is equal to or larger than the threshold value corresponding to the maximum suppliable power ratio Dmax when the input voltage of the commercial AC power supply is a predetermined low voltage. When the calculated value is equal to or larger than the threshold value, the process proceeds to S12. When the calculated value is below the threshold value, the process proceeds to S14. Note that, in the case of the phase control, the CPU 309 calculates the maximum suppliable power ratio Dmax every half-wave period of the commercial AC power supply until the printing-job is finished. Therefore, the comparison between the maximum suppliable power ratio Dmax and a preset threshold value is performed every half-wave.

In S12, the CPU 309 detects that the calculated maximum suppliable power ratio Dmax is the threshold value or larger and determines that the commercial AC power supply voltage has dropped to a predetermined voltage or lower. Therefore, the CPU 309 notifies the video controller 127 that the input voltage of the commercial AC power supply has dropped. Then, the video controller 127 notified of the input voltage drop stops the writing operation in the data storage unit 133. In S13, the CPU 309 notifies a user that the input voltage of the commercial AC power supply has dropped by display on a display unit of the main body 100, and the process proceeds to S15.

In S14, the CPU 309, which determines that the calculated maximum suppliable power ratio Dmax is smaller than the threshold value and that the input voltage of the commercial AC power supply has not dropped to a predetermined voltage, determines whether or not the printing-job is completed. When the CPU 309 determines that the printing-job is completed, the process proceeds to S15. When the CPU 309 determines that the printing-job is not completed, the process proceeds back to S10. In S15, because the printing-job is finished, the CPU 309 turns off the triac TR1 so as to stop feeding current to the ceramic heater 109*c* and finishes the temperature adjustment control. In S16, the CPU 309 finishes the printing operation and proceeds to the standby state, and the process returns to S7.

Note that, in the above description, it is supposed that the CPU 309 performs the phase control. However, also in the case where the CPU 309 performs the wave number control or the hybrid control, it is possible to detect that the input voltage of the commercial AC power supply has dropped based on the control sequence of FIG. 7 in the same manner. Note that, in the case of the phase control, the comparison between the maximum suppliable power ratio Dmax and a preset threshold value in S11 is performed every half-wave. In contrast, in the case of the wave number control or the hybrid control, the calculation of the current value Irms that is used for calculating the maximum suppliable power ratio Dmax is performed every control period. Therefore, the case of the wave number control or the hybrid control is different from the case of the phase control in that the comparison between the maximum suppliable power ratio Dmax and a preset threshold value is performed every control period.

As described above, according to this embodiment, it is possible to detect the drop of the input voltage of the commercial AC power supply. In this embodiment, without adding a new circuit, the value of the maximum suppliable power ratio Dmax can be calculated by using the current value of the heater current detected by the current detection circuit disposed in the heater drive control circuit of the image forming apparatus. When it is determined that the calculated value of the maximum suppliable power ratio Dmax is equal to or larger than the value of the maximum suppliable power ratio Dmax in the case where the input voltage of the commercial AC power supply becomes a predetermined voltage, the video controller is notified of the input voltage drop so that the data writing in the data storage unit is stopped. The data writing in the data storage unit is stopped before the low input voltage protection circuit disposed in the power circuit unit detects the input voltage drop and cuts off the supply of power from the commercial AC power supply. Therefore, it is possible to prevent the data that is being written in the data storage unit from being damaged.

Second Embodiment

In the first embodiment, the drop of the input voltage of the commercial AC power supply is determined based on an increase of the maximum suppliable power ratio Dmax. The maximum suppliable power ratio Dmax is calculated by Expression (3) using the heater current value Irms detected by the current detection circuit 312, the maximum suppliable current value Ilimit, and a parameter of the supply power ratio D to the ceramic heater 109*c* based on the detection temperature of the thermistor 109*d*. The calculation of the maximum suppliable power ratio Dmax is performed every half-wave until the printing-job is completed in the case of the phase control. When the above-mentioned parameter is detected in error, the supply of power to the ceramic heater 109*c* may be promptly stopped, and the printing operation may be stopped. Therefore, in this embodiment, in order to prevent the stop of the printing operation due to misdetection of the parameter, the drop of the input voltage of the commercial AC power supply is detected more securely as described in the following example. Note that, structures of the image forming apparatus and the heating apparatus in this embodiment are the same as those of the first embodiment illustrated in FIGS. 1A, 1B, and 2, and overlapping description is omitted.

<Method of Detecting Input Voltage Drop of Commercial AC Power Supply>

Figure 8:
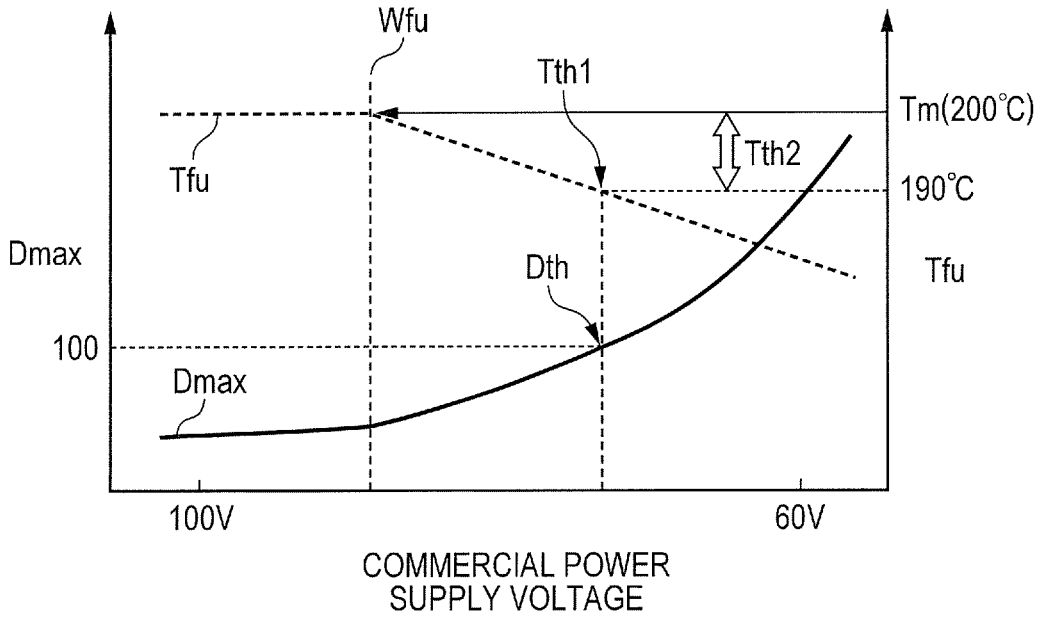
FIG. 8 is a diagram showing a method of detecting the input voltage drop of the commercial AC power supply according to the second embodiment.

FIG. 8 is a diagram showing a method of detecting the input voltage drop of the commercial AC power supply according to this embodiment. In FIG. 8, the horizontal axis represents the input voltage of the commercial AC power supply, the left vertical axis represents the maximum suppliable power ratio Dmax, and the right vertical axis represents a detection temperature Tfu of the heater 109*c* by the thermistor 109*d*. In this embodiment too, similarly to FIGS. 6A and 6B of the first embodiment, it is supposed that the power Wfu necessary for keeping a constant temperature of the heater 109*c* is constant. In FIG. 8, Tm represents the target temperature of the heater 109*c*, and the CPU 309 calculates the phase angle so that the detection temperature Tfu by the thermistor 109*d* remains at the target temperature Tm. In this embodiment, the target temperature Tm is regarded as 200° C. Note that, the current value Irms of the current detection circuit 312 is the same as the output value shown in FIGS. 6A and 6B, and hence the current value Irms is not shown in FIG. 8.

When the input voltage of the commercial AC power supply is a voltage that can supply the power Wfu necessary for keeping a constant temperature of the heater 109*c*, the temperature of the heater 109*c* is controlled to be constant. Therefore, the detection temperature Tfu (broken line) by the thermistor 109*d* is also constant. However, when the input voltage of the commercial AC power supply gradually drops and the power Wfu necessary for keeping a constant temperature of the fuser 109 cannot be supplied, the detection temperature Tfu of the heater 109*c* gradually drops in accordance with the power that can be supplied. In addition, the maximum suppliable power ratio Dmax increases along with the drop of the input voltage of the commercial AC power supply as described above in the first embodiment.

In this embodiment, the CPU 309 determines that the input voltage of the commercial AC power supply has dropped when the detection temperature Tfu by the thermistor 109*d* is a predetermined temperature threshold value Tth1 or lower in addition to the fact that the maximum suppliable power ratio Dmax is the predetermined threshold value Dth or higher. The condition that "the maximum suppliable power ratio Dmax is higher than the predetermined threshold value Dth" is the reference condition for determining the input voltage drop in the first embodiment. In this embodiment, in order to prevent misdetection of the input voltage drop due to misdetection of the parameter, the condition that "the detection temperature Tfu by the thermistor 109*d* is the predetermined temperature threshold value Tth1 or lower" is newly added to the reference determination condition of the first embodiment, and the detection of the input voltage drop is determined.

In FIG. 8, the threshold value Dth of the maximum suppliable power ratio Dmax is set to 100, and the threshold value Tth1 of the detection temperature by the thermistor 109*d* is set to 190° C. (second threshold value). The CPU 309 determines based on the parameter that the input voltage of the commercial AC power supply has dropped when the maximum suppliable power ratio Dmax calculated by Expression (3) is 100 or larger and the detection temperature Tfu1 by the thermistor 109*d* is 190° C. or lower (second threshold value or lower). The CPU 309 notifies the video controller 127 of the input voltage drop. When the video controller 127 notified of the input voltage drop stops the writing operation in the data storage unit 133. Further, the CPU 309 can display the drop of the power supply voltage on the display unit of the main body 100 so as to warn the user. In addition, the determination by the temperature threshold value Tth1 may be performed when "a difference between the target temperature Tm and the detection temperature Tfu by the thermistor 109*d* is a predetermined temperature threshold value Tth2 or larger (third threshold value or larger)." For instance, in the case of FIG. 8, the target temperature Tm is 200° C., and the temperature threshold value Tth2 is 10° C. (=200° C.−190° C.).

<Control Sequence for Detecting Input Voltage of Commercial AC Power Supply>

Figure 9:
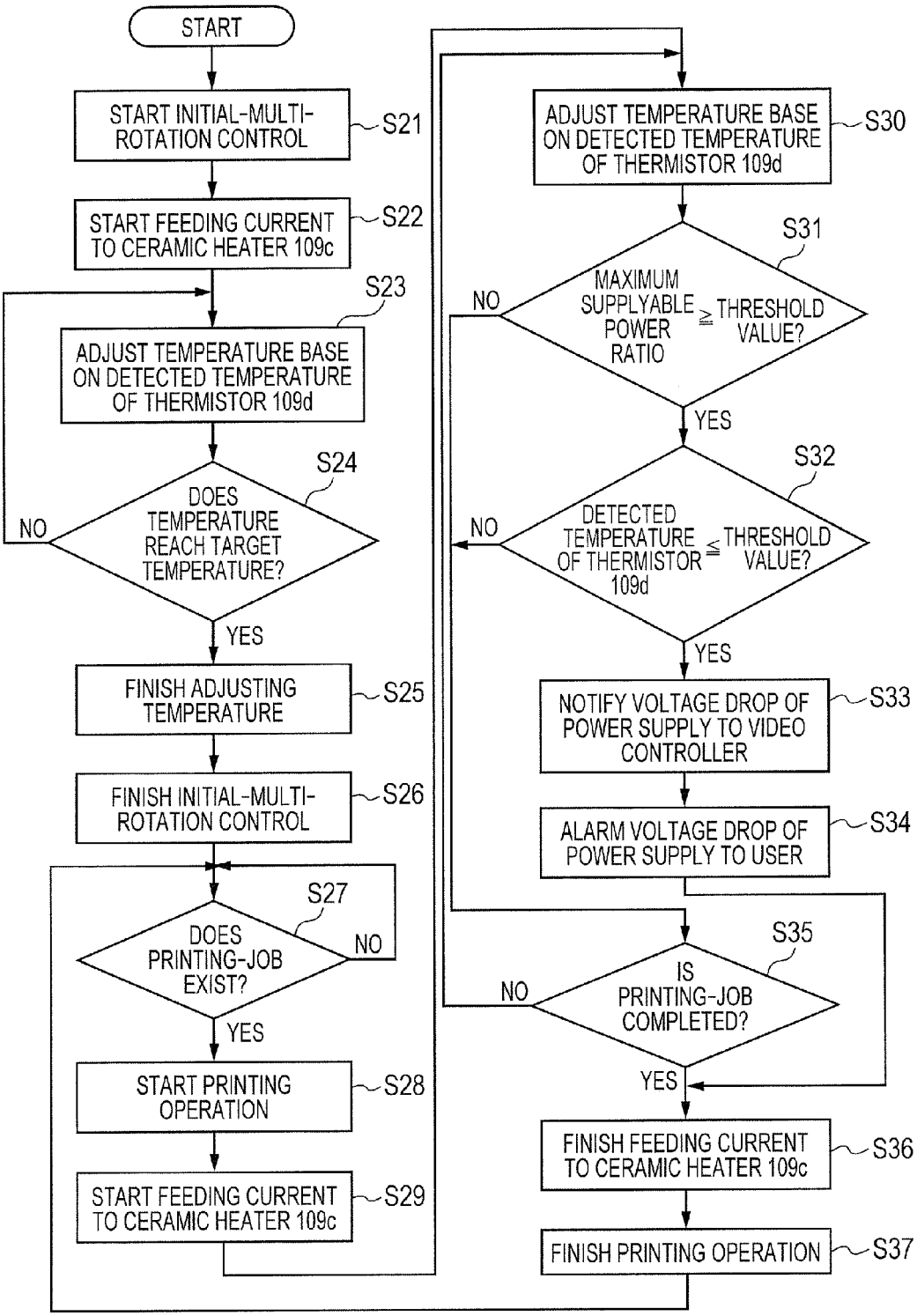
FIG. 9 is a flowchart illustrating a control sequence for detecting the input voltage drop of the commercial AC power supply according to the second embodiment.

A control sequence for detecting the drop of the input voltage of the commercial AC power supply in this embodiment is described below. FIG. 9 is a flowchart illustrating the control sequence for detecting the drop of the input voltage of the commercial AC power supply. The process illustrated in FIG. 9 is performed by the CPU 309 of the engine controller 126 based on a control program stored in the ROM of the CPU 309 similarly to FIG. 7 of the first embodiment. Note that, in the following description of the flowchart of FIG. 9, it is supposed that the feed current control of the heater 109*c* is based on the phase control.

The process of S21 to S30 is the same as that of S1 to S10 of the first embodiment illustrated in FIG. 7, and overlapping description is omitted.

In S31, the CPU 309 calculates the current value Irms of the heater current flowing in the ceramic heater 109*c* based on the CURRMS signal output from the current detection circuit 312. In addition, the CPU 309 calculates the current supply power ratio D to the ceramic heater 109*c* by Expression (1) based on the temperature detection result of the thermistor

109*d*. Then, the CPU 309 calculates the maximum suppliable power ratio Dmax by Expression (3) using the calculated current value Irms, the supply power ratio D, and the maximum suppliable current value Ilimit. Next, the CPU 309 determines whether or not the calculated value of the maximum suppliable power ratio Dmax is equal to or larger than the threshold value corresponding to the maximum suppliable power ratio Dmax when the input voltage of the commercial AC power supply is a predetermined low voltage. When the calculated value is equal to or larger than the threshold value, the process proceeds to S32. When the calculated value is below the threshold value, the process proceeds to S35. Note that, the CPU 309 calculates the maximum suppliable power ratio Dmax every half-wave period of the commercial AC power supply until the printing-job is completed in the case of the phase control. Therefore, the comparison between the maximum suppliable power ratio Dmax and a preset threshold value is performed every half-wave.

In S32, because it is detected in S31 that the calculated maximum suppliable power ratio Dmax is equal to or larger than the threshold value, the CPU 309 next determines whether or not the detection temperature by the thermistor 109*d* is the temperature threshold value or lower. Then, when the detection temperature by the thermistor 109*d* is the temperature threshold value or lower, the CPU 309 determines that the input voltage of the commercial AC power supply has dropped to the predetermined voltage or lower, and the process proceeds to S33. On the contrary, when the detection temperature by the thermistor 109*d* is higher than the temperature threshold value, the CPU 309 determines that the calculated maximum suppliable power ratio Dmax is misdetection, and the process proceeds to S35. Note that, the reference determination condition of S32 may be "whether or not a difference between the target temperature Tm and the detection temperature by the thermistor 109*d* is a predetermined temperature threshold value or larger," which is the reference determination condition described above.

The process of S33 and S34 is performed by the CPU 309 when it is determined that the commercial AC power supply voltage has dropped to the predetermined voltage or lower, which is the same as the process of S12 and S13 of the first embodiment, and overlapping description is omitted.

The process of S35 to S37 is performed by the CPU 309 when it is determined that the maximum suppliable power ratio Dmax is smaller than the threshold value, or when it is determined that the maximum suppliable power ratio Dmax is the threshold value or larger but the detection temperature by the thermistor 109*d* is higher than the temperature threshold value. The process of S35 to S37 is the same as the process of S14 to S16 of the first embodiment, and overlapping description is omitted.

Note that, in the above description, it is supposed that the CPU 309 performs the phase control. However, also in the case where the CPU 309 performs the wave number control or the hybrid control, it is possible to detect that the input voltage of the commercial AC power supply has dropped based on the control sequence of FIG. 9 in the same manner as in the first embodiment. Note that, similarly to the first embodiment, in the case of the wave number control or the hybrid control, the comparison between the maximum suppliable power ratio Dmax and the preset threshold value in S31 is performed every control period, which is different from the case of the phase control that is performed every half-wave.

As described above, according to this embodiment, the drop of the input voltage of the commercial AC power supply can be detected. In this embodiment, not only the determination of the input voltage drop of the commercial AC power supply based on the maximum suppliable power ratio Dmax but also the determination of the input voltage drop of the commercial AC power supply based on the detection temperature by the thermistor 109*d* is performed. Therefore, the input voltage drop can be detected more securely. As a result, the data writing in the data storage unit can be stopped before the low input voltage protection circuit of the power circuit unit detects the input voltage drop and shuts down the supply of power from the commercial AC power supply. Therefore, it is possible to prevent data that is being written in the data storage unit from being damaged.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-087406, filed Apr. 6, 2012, which is hereby incorporated by reference herein in its entirety.

What is claimed is:

1. A heating apparatus, comprising:

a heat generating member which generates heat when power is supplied from an AC power supply;

a temperature detection device which detects a temperature of the heat generating member;

a current detection device which detects a value of current flowing in the heat generating member; and a control unit which controls the temperature of the heat generating member by controlling the power supplied to the heat generating member, wherein the control unit detects a drop of an input voltage of the AC power supply based on a maximum suppliable power ratio obtained by using a value of current suppliable to the heat generating member, a current value detected by the current detection device, and a ratio of power supplied to the heat generating member obtained based on the temperature detected by the temperature detection device.

2. A heating apparatus according to claim 1, wherein the control unit determines that the input voltage of the AC power supply is dropped when the maximum suppliable power ratio is a first threshold value or larger.

3. A heating apparatus according to claim 1, wherein the control unit determines that the input voltage of the AC power supply is dropped in a case where the maximum suppliable power ratio is equal to or more than a first threshold value and the temperature detected by the temperature detection device is equal to or less than a second threshold value.

4. A heating apparatus according to claim 1, wherein the control unit determines that the input voltage of the AC power supply is dropped in a case where the maximum suppliable power ratio is equal to or more than a first threshold value and a difference between the temperature detected by the temperature detection device and a target temperature of the heat generating member is equal to or more than a third threshold value or higher.

5. A heating apparatus according to claim 1, wherein the control unit controls the power supplied to the heat generating member based on phase control in which feed current control is performed at a predetermined phase angle in one half-wave of the AC power supply.

6. A heating apparatus according to claim 1, wherein the control unit controls the power supplied to the heat generating member based on wave number control in which feed current control is performed by a half-wave of the AC power supply.

7. A heating apparatus according to claim 1, wherein the control unit controls the power supplied to the heat generating member by a combination of phase control in which feed current control is performed at a predetermined phase angle in one half-wave of the AC power supply and wave number control in which feed current control is performed by a half-wave of the AC power supply.

8. An image forming apparatus, comprising:

an image forming unit configured to form an image on a recording medium; and a fixing unit configured to fix the image on the recording medium by heating the recording medium on which the image is formed by the image forming unit, wherein the fixing unit includes a heat generating member which generates heat when power is supplied from an AC power supply, a temperature detection device which detects temperature of the heat generating member, a current detection device which detects a value of current flowing in the heat generating member, and a control unit which controls the temperature of the heat generating member by controlling power supplied to the heat generating member, and wherein the control unit detects a drop of an input voltage of the AC power supply based on a maximum suppliable power ratio determined by using a value of current suppliable to the heat generating member, a current value detected by the current detection device, and a ratio of power supplied to the heat generating member obtained based on the temperature detected by the temperature detection device.

9. An image forming apparatus according to claim 8, further comprising a low input voltage protection unit which detects a drop of the input voltage of the AC power supply, wherein a voltage at which the low input voltage protection unit detects a drop of the input voltage of the AC power supply is lower than a voltage at which the control unit detects a drop of the input voltage of the AC power supply.

10. An image forming apparatus according to claim 8, further comprising a data storage unit which stores data, and a storage control unit which controls operation of the data storage unit, wherein when the control unit detects the drop of the input voltage of the AC power supply, the control unit notifies the storage control unit of the drop of the input voltage.

11. An image forming apparatus according to claim 10, wherein the data storage unit comprises a hard disk drive.

* * * * *